US005433293A

United States Patent [19]

Sager

[11] Patent Number: 5,433,293

[45] Date of Patent: Jul. 18, 1995

[54] VERTICAL-HORIZONTAL PASSENGER CONVEYING SYSTEM

[75] Inventor: Edmund Sager, Meggen, Switzerland

[73] Assignee: Inventio AG, Hergiswil NW, Switzerland

[21] Appl. No.: 210,030

[22] Filed: Mar. 17, 1994

[30] Foreign Application Priority Data

Mar. 18, 1993 [EP] European Pat. Off. ..... 93104414

[51] Int. Cl.[6] ..... B66B 9/00

[52] U.S. Cl. ..... 187/249; 187/371; 182/12

[58] Field of Search ..... 187/249, 270, 361, 371, 187/406; 182/12, 13, 148; 414/246

[56] References Cited

U.S. PATENT DOCUMENTS

| | | | |
|---|---|---|---|
| 2,052,690 | 9/1936 | Austin | 187/249 |
| 3,317,005 | 5/1967 | Kehoe | 187/249 |
| 3,658,155 | 4/1972 | Salter | 187/16 |
| 4,865,155 | 9/1989 | Montaigne et al. | 187/249 |

FOREIGN PATENT DOCUMENTS

| | | |
|---|---|---|
| 0388814 | 9/1990 | European Pat. Off. . |
| 2618237 | 11/1977 | Germany . |
| 3939762 | 6/1991 | Germany . |

*Primary Examiner*—Kenneth Noland
*Attorney, Agent, or Firm*—Howard & Howard

[57] ABSTRACT

A vertical-horizontal passenger conveying system includes elevator cars provided with individual drives for travel in intersecting vertical and horizontal shafts. The shafts have fixed and movable vertical guide rails with steps which are engaged by roller chains of the drives wherein more than one car can travel in the same shaft at the same time. The movable rails are latched in a vertical position for vertical travel of the cars and are pivoted out of the way for entrance of a car into an horizontal shaft. Supports on the cars or in the shafts relieve the force applied to the steps through the chains to permit movement of the movable rails. Deflecting and tensioning rollers for the chains have flanges for running on horizontal guide rails in the horizontal shafts.

20 Claims, 6 Drawing Sheets

VERTICAL-HORIZONTAL PASSENGER CONVEYING SYSTEM

BACKGROUND OF THE INVENTION

The present invention relates generally to an apparatus for conveying passengers and, in particular, to a system for conveying passengers in cars travelling in intersecting vertical and horizontal elevator shafts.

A passenger conveying system is illustrated and described in the U.S. Pat. No. 3,658,155. A plurality of self-propelled cars move vertically in the same elevator shaft and can move laterally from the shaft at any floor. The drive means mounted on each car is a motor and a chain transmission on an axially displaceable shaft with toothed pinions at the end. The pinions engage a multi-track toothed rack, wherein one track extends only vertically, another leads horizontally to the left at floors and a third leads horizontally to the right at floors. The appropriate travel track is chosen by the extent of the axial displacement of the pinion shaft. The car is suspended by the drive and is guided in the shafts by additional support wheels at the four corners. Special mechanical equipment keeps the toothed pinions in engagement during a change in direction of the car.

This system requires many precision mechanical parts; in particular, the different toothed racks are costly. Furthermore, corresponding safety equipment must be provided in case of breakage of a drive means part.

Another drive means for a passenger conveying car is shown in the German Patent Specification No. 39 39 762. The car drive includes an endless toothed belt which has teeth formed on both sides. A drive wheel and a deflecting or tensioning roller engage the inwardly directed teeth. The outwardly directed teeth engage a toothed rack which also serves to guide the car in a vertical path. Due to the tooth shapes of the toothed rack and of the toothed belt, a contact pressure device must be provided to force the belt against the rack. This contact pressure device consists of another toothed belt with a number of pressure rollers or, in a different form, several pressure rollers arranged in a row in a support.

This system requires a relatively fine toothed rack and an additional contact pressure device. Safety devices are not used since the system is installed at a building site. However, safety devices would be required for regular passenger transport use.

SUMMARY OF THE INVENTION

The present invention concerns a system for conveying passengers in cars which travel in intersecting vertical and horizontal elevator shafts. A vertical-horizontal passenger conveying system includes cars having individual drives for independent travel in the vertical and horizontal shafts and fixed and movable guide rails mounted in the shafts which are engaged by the drives wherein more than one of the cars can travel in the same shaft at the same time. The system comprises: elevator cars having at least two endless conveying roller chains each with a portion which extends outside the car in a generally vertical direction; drive means mounted on the cars and connected to the chains for moving the chains; vertical guide rails for attachment to side walls of a vertical elevator shaft, the vertical guide rails each having a plurality of steps formed thereon for engaging an associated one of the chains; horizontal guide rails for attachment to a bottom wall of an horizontal elevator shaft intersecting the vertical elevator shaft, each of the vertical guide rails having a movable rail portion for pivotally mounting at the intersection of the vertical and horizontal shafts in alignment with an associated one of the horizontal guide rails; at least one deflecting roller rotatably mounted on the car for each chain, the chains extending partially around the associated deflecting rollers, the deflecting rollers being driven by the chains and engaging the horizontal guide rails when the car travels in the horizontal shaft; and retractable and extendable support means mounted on either the car or the bottom wall of the horizontal shaft for supporting the car to relieve the chains from engagement with the steps whereby the movable rail portions can be pivoted away from the car.

Each drive means includes a motor mounted in the car, a chain wheel rotatably mounted in the car and engaging an associated one of the chains and a reduction gear connected between the motor and the chain wheel whereby the motor moves the chain by driving the chain wheel through the reduction gear. The system also includes a chain tensioning and safety means mounted in the car for tensioning each of the chains whereby when tension is lost on one of the chains, a spring urges a brake shoe into engagement with an adjacent wall of an elevator shaft to stop travel of the car. A switch cam is attached to the spring, a switch contact is mounted on the car and an electrical line is connected to the switch contact whereby when tension is lost on the chain, the spring moves the switch cam into engagement with the switch contact for generating a signal on the electrical line.

One of the advantages of the present invention is that relatively inexpensive guide rails of a standard U-shaped profile can be used and the steps required for engaging the roller chains can be formed at greater spacings (integer multiples) than the rollers of the chain. Furthermore, the steps can be formed by simple mechanical operations.

Another advantage is that the drives on the cars serve for both directions of travel, vertical and horizontal, and the roller chains do not require contact pressure devices. Also, a car brake and a safety contact are actuated in the case of a chain fracture.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
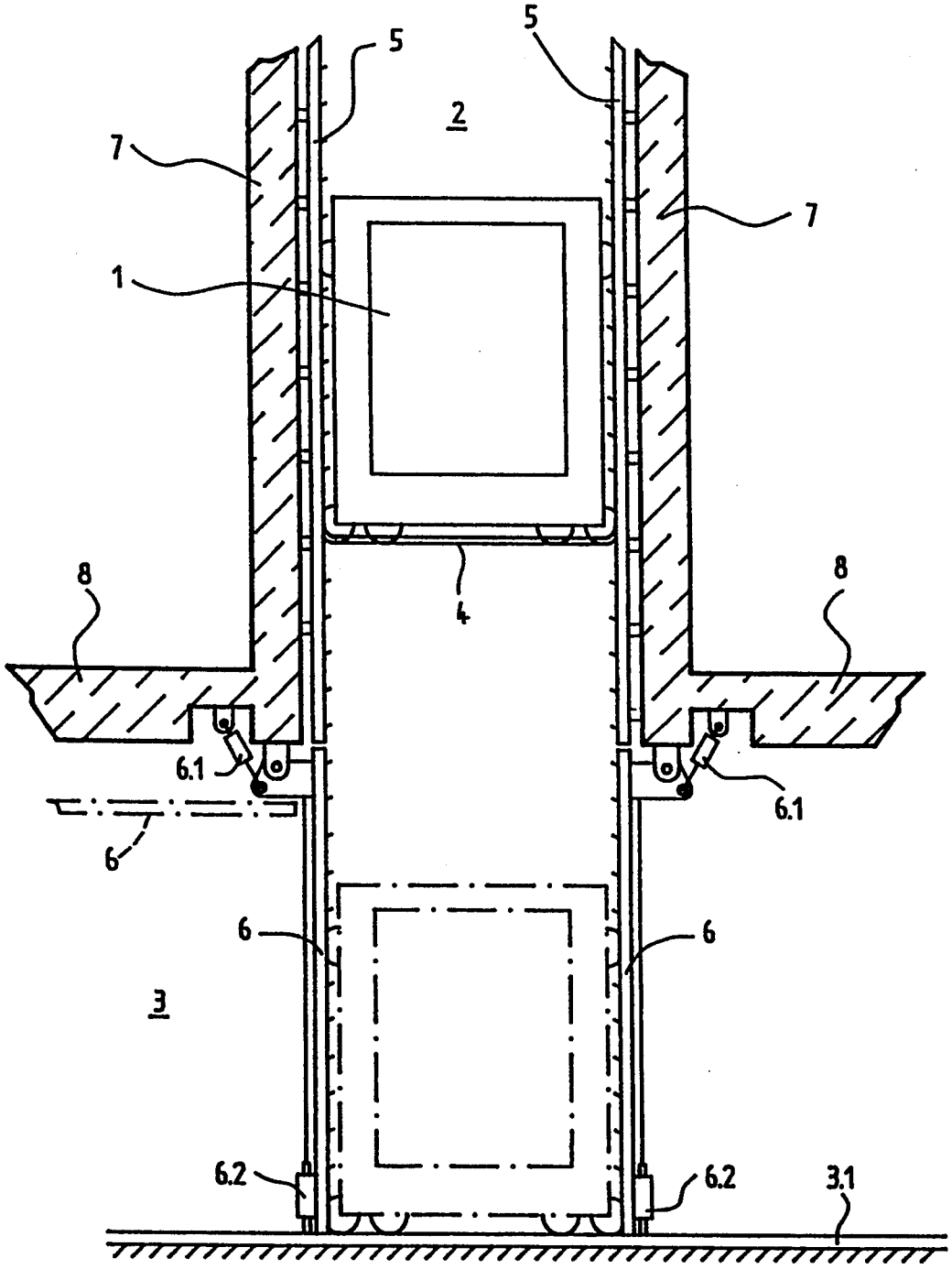
FIG. 1 is a cross-sectional schematic view of a lower portion of a vertical-horizontal passenger conveying system in accordance with the present invention.

In the FIG. 1, there is shown a vertical-horizontal passenger conveying system including an elevator car 1 which is guided for vertical travel in a vertically extending elevator shaft 2. A lower end of the elevator shaft 2 intersects an horizontally extending elevator shaft 3 in which the car 1 also travels. The elevator car 1 is supported and moved in the shaft 2 by a pair of endless roller chains 4 each of which extends vertically down an associated side wall and substantially across an underside of the car 1 (see the FIG. 4). The chains 4 engage an associated one of a pair of vertically extending guide rails 5 which are fixedly attached to opposed side walls 7 of the vertical shaft 2.

The lower ends of the guide rails 5 terminate at the opening of the vertical shaft 2 into the horizontal shaft 3. However, the guide rails are extended by a pair of vertically extending, movable rail portions 6 which are aligned with the respective ones of the guide rails 5 to guide the car 1 to the bottom wall common to the shafts 2 and 3. An upper end of each of the rail portions 6 is pivotally attached to an upper wall or ceiling 8 of the shaft 3 by a respective pivoting mechanism 6.1. On the left-hand side of the FIG. 1, the corresponding guide rail portion 6 is also shown in phantom in the upwardly pivoted horizontal position. In the vertical position, each of the movable rail portions 6 is attached to a bottom wall or floor of the shaft 3 by a corresponding latching mechanism 6.2 which, for example, can include a latching pin penetrating an aperture formed in a corresponding one of a pair of horizontal guide rails 3.1 attached to the floor of the shaft 3. The latching mechanisms 6.2 hold the associated rail portions 6 securely in the vertical position under the load of the car 1. Each of the latching mechanisms 6.2 is connected by a linkage with the corresponding pivoting mechanism 6.1 and is actuated to release the lower ends of the guide rail portions 6 from the guide rails 3.1 during the pivoting movement from the vertical to the horizontal position.

Figure 2:
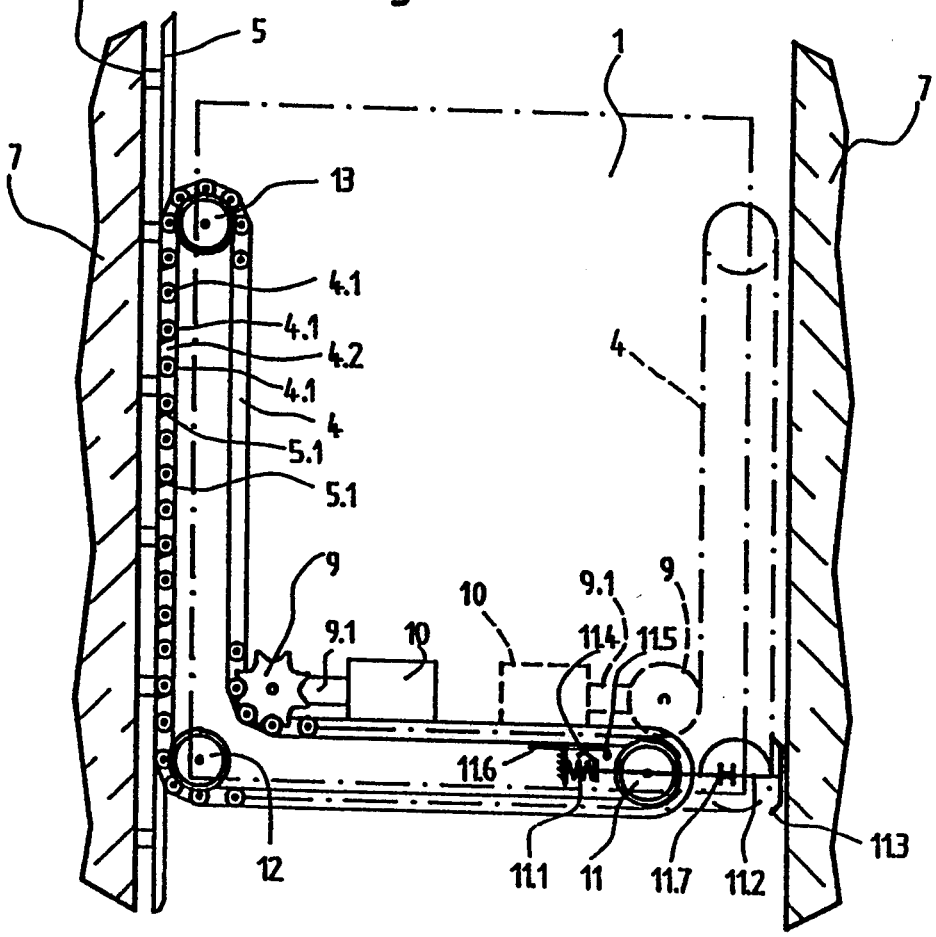
FIG. 2 is an enlarged fragmentary view of the elevator car and a portion of the vertical elevator shaft shown in the FIG. 1.

The details of the car drive means are illustrated in the FIG. 2. A first drive means at the left side of the car 1 is shown in solid lines and is discussed in detail below. A second drive means at the right side of the car 1 is shown in dashed lines and is similar in construction and operation to the first drive means. The conveying chain 4 is an endless roller chain formed of a plurality of spaced apart rollers 4.1 with adjacent ones of the rollers being connected at corresponding ends by pivotally attached straps 4.2. The chain 4 is driven by a toothed chain wheel 9 rotatably mounted inside the car 1 adjacent the left side wall. The chain wheel 9 is driven in rotation by a motor 10 through a reduction gear 9.1 connected between the wheel 9 and an output shaft of the motor 10. The chain 4 extends partially around its associated chain wheel 9 and horizontally toward the right side wall of the car 1. The chain 4 extends partially around a deflecting and tensioning roller 11 rotatably mounted in the right half of the car 1 and exits a bottom wall of the car. The chain 4 then extends horizontally below the underside of the car 1 back toward the left side of the car and partially around a lower deflecting roller 12 rotatably mounted at a lower left corner of the car. The chain 4 extends upwardly along the outside of the left side wall of the car 1 in the guide rail 5 and partially around an upper deflecting roller 13 rotatably mounted near the upper left corner of the car. The chain 4 enters through the left side wall of the car 1 and extends downwardly in the car to return to the chain wheel 9.

A chain tensioning and safety means includes the deflecting and tensioning roller 11 which is urged to the right by a spring 11.1 having a left-hand end attached to the car 1 and a right-hand end attached to one end of a push-rod 11.2 which is connected at a mid-point to the pivot point of the roller 11 for tensioning of the conveying chain 4. An opposite end of the push-rod 11.2 extends through the right-hand side wall of the car 1 and is attached to a brake shoe 11.3. A switch cam 11.4 is attached to the right-hand end of the spring 11.1 for engaging an electrical contact 11.5 mounted in the car 1 upon a relaxation of the chain tension, for example as a consequence of a break in the chain 4. The electrical contact 11.5 is connected by an electrical line 11.6 with a not illustrated safety circuit for generating a signal representing the status of the chain tension. Also mounted in the car 1 between the roller 11 and the right-hand side wall is a guide 11.7 through which the push-rod 11.2 extends. A small spacing of, for example, one to five centimeters is present between the braking surface of the brake shoe 11.3 and the facing one of the shaft walls 7.

The guide rails 5 each have a plurality of generally horizontally extending steps 5.1 formed therein which are spaced to engage, for example, every other one of the rollers 4.1. The guide rails 5 are firmly attached to the shaft walls 7 by a plurality of mountings 5.2. Thus, as the chains 4 are driven by the wheels 9, the rollers 4.1 engage the steps and move the car 1. If the portion of the chain 4 extending through the guide rail is moving downwardly, the car 1 is moved upwardly. If the portion of the chain 4 extending through the guide rail is moving upwardly, the car 1 is moved downwardly.

Figure 3A:
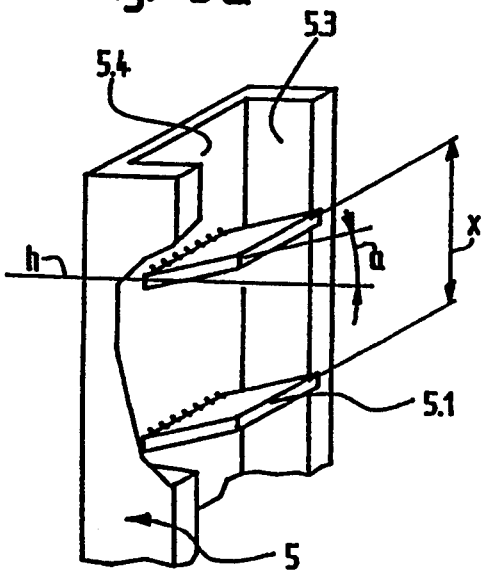
FIG. 3*a* is an enlarged fragmentary perspective view of the vertical guide rail shown in the FIG. 2.
Figure 3B:
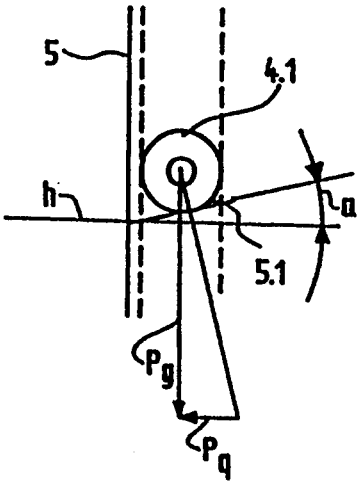
FIG. 3*b* is schematic diagram of the relationship between the guide rail and one of the rollers shown in the FIG. 2.

In the FIG. 3*a*, a portion of the guide rail 5 is shown in detail. The rail 5 is generally channel or U-shaped in cross section with a longitudinally extending base 5.4 and transverse side legs 5.3 extending from the longitudinal edges of the base. The steps 5.1 are arranged at regular spacings "x" on the longitudinal axis of the base 5.4 and extend toward the opening between the legs 5.3 of the guide rail 5. The width of the steps 5.1 corresponds with some play to the width of the rollers 4.1 of the conveying chain 4. Between the side edges of the steps 5.1 and the inwardly facing surfaces of the legs 5.3, there is a respective free intermediate space which with some play corresponds to twice the thickness of the strap 4.2 of the conveying chain 4. The height of the legs 5.3 is, for example, chosen so the outer edge of the leg 5.3 is slightly below the rotational axis of the rollers 4.1 when the conveying chain 4 is engaged with the rail 5. The spacing "x" between the steps 5.1 corresponds to an integral multiple of the pitch of the conveying chain 4, the distance between the axes of rotation of adjacent rollers, which multiple is "two" in the illustrated example. The steps 5.1 are angled upwardly at a positive angle "a" to the horizontal plane "h". The effect of this arrangement is illustrated in the force diagram shown in the FIG. 3*b* in which Pg is the vertical force and Pq is the lateral force directed towards the base 5.4 of the guide rail 5 resulting from the load supported by the roller 4.1 resting on the inclined bearing surface of the step 5.1. The guide rail portions are similar in construction.

Figure 4:
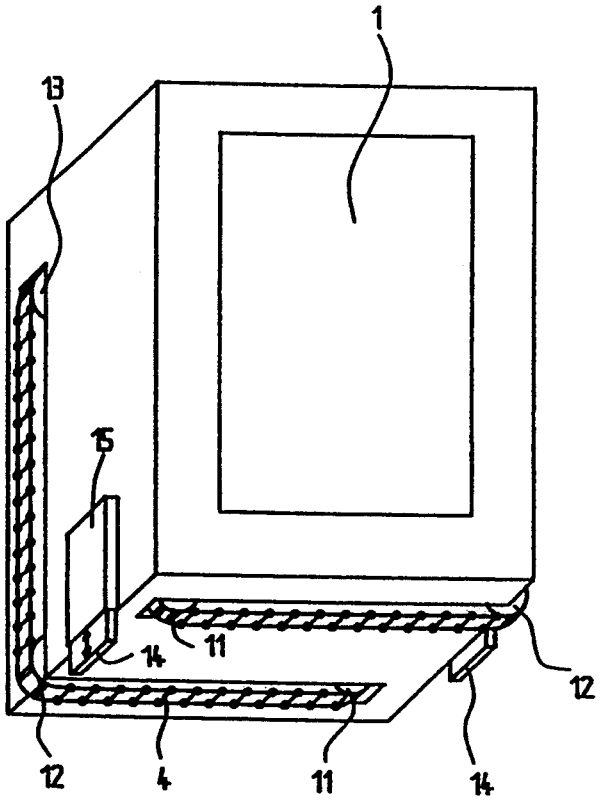
FIG. 4 is a perspective view of the elevator car and the associated drive means shown in the FIG. 2.

The locations of the two conveying chains 4 relative to the sides of the car 1 are shown in the FIG. 4. The vertically extending portions of the conveying chains 4 exterior to the car 1 are located adjacent diagonally opposite corners of the car. On the underside of the car 1, the conveying chains 4 extend parallel to one another over about 90% of the width of the car. A pair of plunger guides 15 having retractable and vertically extendible rectangular support plungers 14 are attached at the lower edges of the car side walls. A not illustrated mechanism in the plunger guide 15 enables the retraction and extension of the support plungers 14 for relieving pressure on the chains 4 as will be described below.

Figure 5:
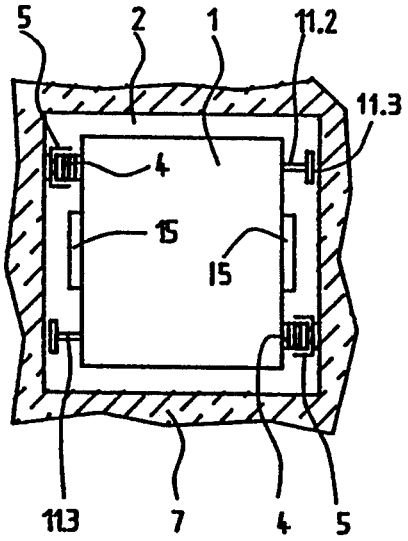
FIG. 5 is a reduced top plan view of the elevator car and elevator shaft shown in the FIG. 2.

The relationship of the aforementioned parts is evident in the FIG. 5. The conveying chains 4 are engaged in the respective guide rails 5 to center the car 1 in the shaft 2. The brake shoes 11.3 move along the shaft walls 7 at a small spacing therefrom. The plunger guides 15 are positioned in about the center of the car sides.

Figure 6:
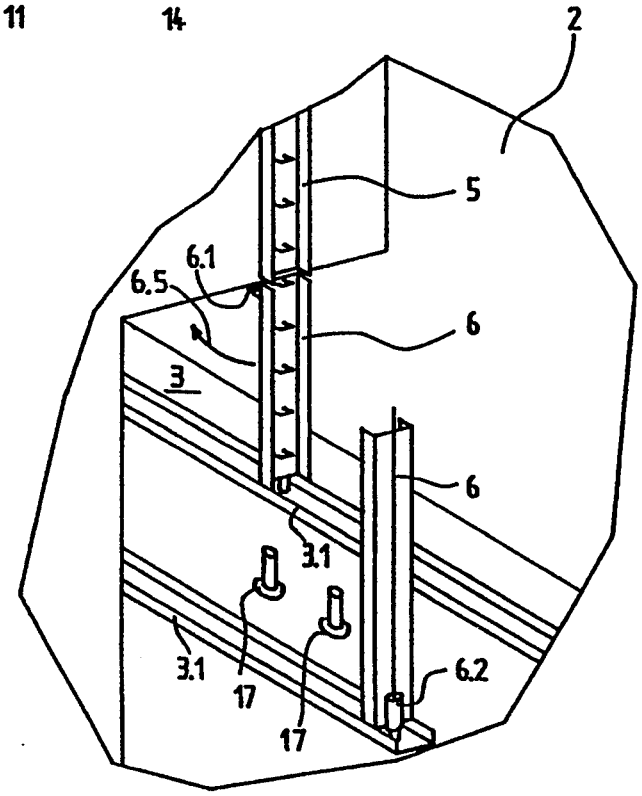
FIG. 6 is a fragmentary perspective view of the intersection of the vertical and horizontal shafts shown in the FIG. 1.

FIG. 6 shows the intersection of the bottom of the vertical shaft 2 with the horizontal shaft 3. The guide rails 5 terminate at level of the ceiling 8 of the horizontal shaft 3 and are continued by the upwardly pivotable rail portions 6. As shown, the rail portions 6 are disposed in the downwardly pivoted and latched position so that an elevator car could travel down the shaft 2 into the horizontal shaft 3. An arrow 6.5 indicates the course of movement of the guide rail 6 during an upward pivot. Installed on the bottom wall of the horizontal shaft 3 are the two horizontal guide rails 3.1 with a spacing width coinciding with the spacing between the conveying chains 4 along the underside of the car 1. Installed between the guide mils 3.1 are two retractable and extendible support plungers 17 for engaging the underside of the car 1 as will be discussed below.

Figure 7A:
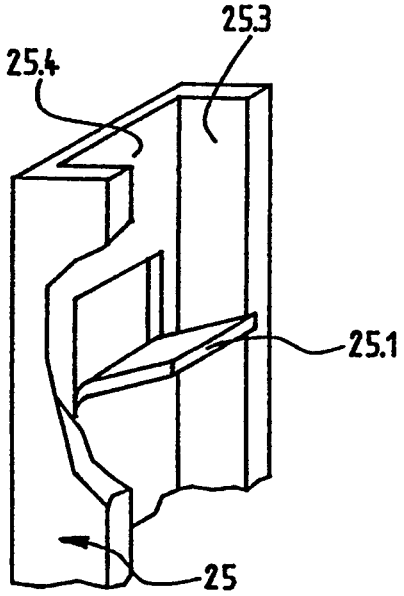
FIG. 7*a* is an enlarged fragmentary perspective view, similar to the FIG. 3*a*, of an alternate embodiment of the vertical guide rail shown in the FIG. 2.
Figure 7B:
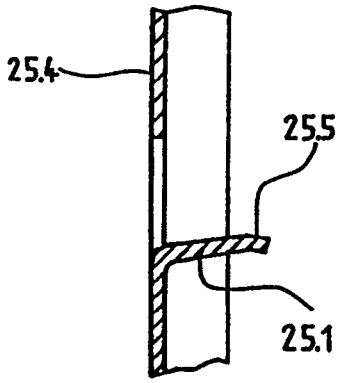
FIG. 7*b* is a cross-sectional view of the guide rail shown in the FIG. 7*a;*

There is shown in the FIGS. 7*a* and 7*b* an alternate embodiment of the guide rail 5 shown in the FIG. 3*a*. A guide rail 25 is generally U-shaped with a base 25.4 and transverse legs 25.3. A plurality of steps 25.1, only one of which is shown, are formed by punching and bending out portions of the base 25.4 as shown. An end portion 25.5 of the step 25.1 can be rounded downwardly as is illustrated in the FIG. 7*b*.

Figure 8:
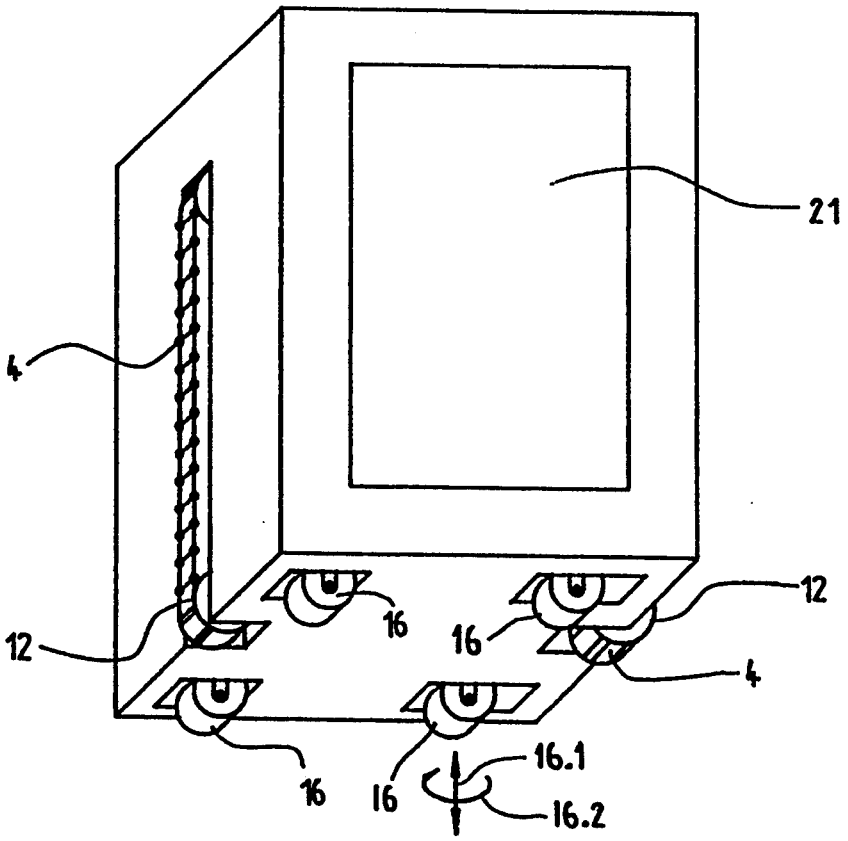
FIG. 8 is a perspective view of the elevator car, similar to the FIG. 4, showing an alternate embodiment of the drive means.

The FIG. 8 shows an alternate embodiment of the drive means shown in the FIG. 4. An elevator car 21 has a pair of the conveying chains 4 which are installed in the center of opposed side walls of the car with only the vertically extending portions of the chains extending outside the car. A plurality of support rollers 16 are attached with one at each of the four corners of the underside of the car 21 wherein, as indicated by an arrow 16.1, these rollers are extendable and retractable along a lifting axis and, as indicated by an arrow 16.2, these rollers can be rotatable about the lifting axis. In the extended position, the support rollers 16 project downwardly beyond lower deflecting rollers 12 associated with the conveying chains 4 so that the conveying chains 4 do not touch the horizontal guide rails 3.1 when the car 21 is positioned in the horizontal shaft 3.

Figure 9A:
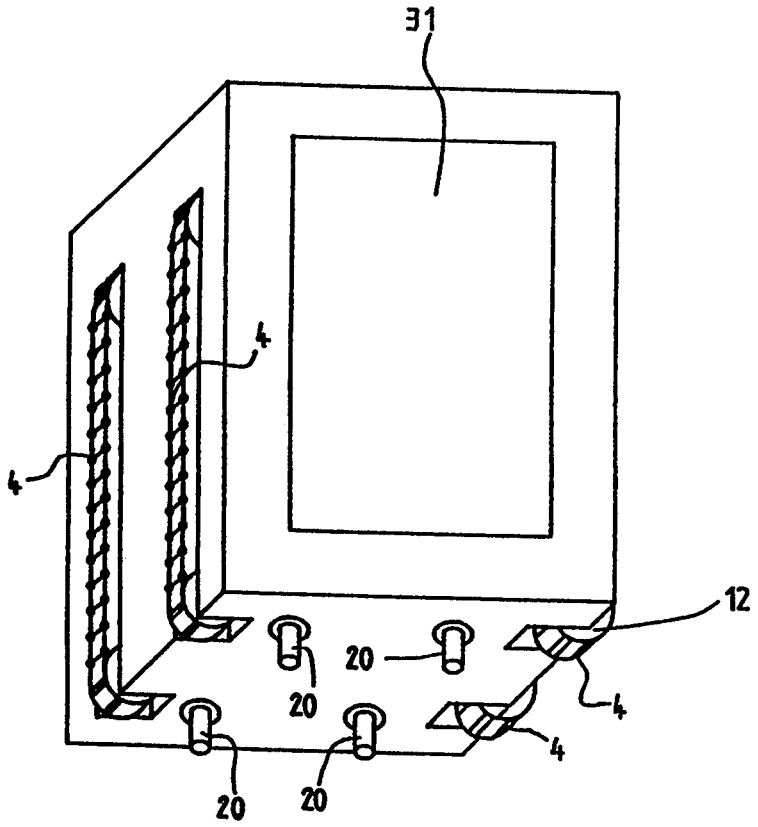
FIG. 9*a* is a perspective view of the elevator car, similar to the FIG. 4, showing a second alternate embodiment of the drive means.

A second alternate embodiment of the drive means is shown in the FIG. 9*a* wherein a pair of generally parallel vertically extending conveying chains 4 are provided on each side of an elevator car 31. Of course, two pair of the guide rails 5 are required in the shaft 2. Four support plungers 20 are mounted in a square pattern on the underside of the car 31. The plungers 20 can be arranged at the same track width as the conveying chains 4 so that, on being extended, they enter the guide rails 3.1 in the horizontal shaft 3.

Figure 9B:
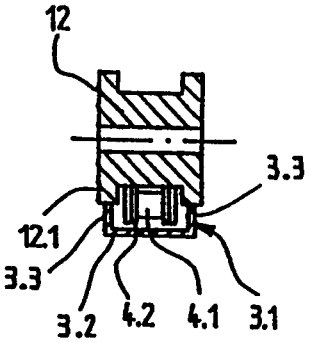
FIG. 9*b* is an enlarged cross-sectional view of the lower deflecting roller shown in the FIGS. 2, 4, 8 and 9*a;*

As shown in the FIG. 9*b*, the lower deflecting rollers 12 associated with the chains 4 include radially projecting circumferential flanges 12.1 so that, during horizontal travel of the cars 1, 21 and 31, the flanges 12.1 engage and travel on free edges of legs 3.3 of the horizontal guide rails 3.1 without the rollers 4.1 or the straps 4.2 of the conveying chains 4 touching a base 3.2 of the guide rails 3.1. Although not shown, the deflecting and tensioning rollers 11 also include flanges similar to the flanges 12.1 for engaging the legs 3.3.

Figure 10:
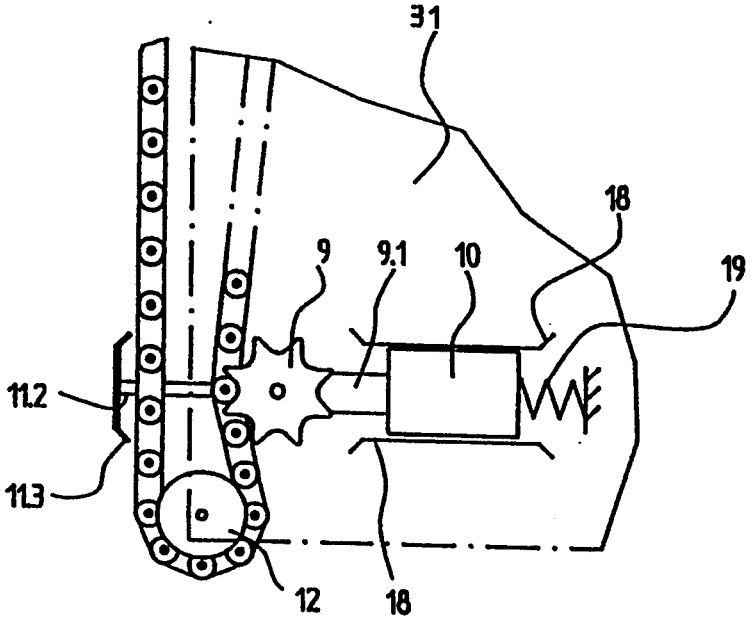
FIG. 10 is an enlarged fragmentary cross-sectional view of the drive means shown in the FIGS. 8 and 9*a;*

The drive means for the elevator cars 21 and 31 is illustrated in more detail in the FIG. 10. The drive motor 10 is supported in a generally horizontally extending sliding guide 18 mounted in the car 31. A compression spring 19 has one end attached to the car 31 and an opposite end attached to the motor 10. The motor 10, the reduction gear 9.1 and the chain wheel 9 are urged by the compression spring 19 against the conveying chain 4 to maintain tension on the conveying chain. The push-rod 11.2 is connected at the point of rotation of the wheel 9 and has the brake shoe 11.3 attached to a free end thereof. The point of engagement of the wheel 9 with the chain 4 is directly above the lower deflecting roller 12 in order to obtain an adequate looping angle for the chain 4.

Figure 11:
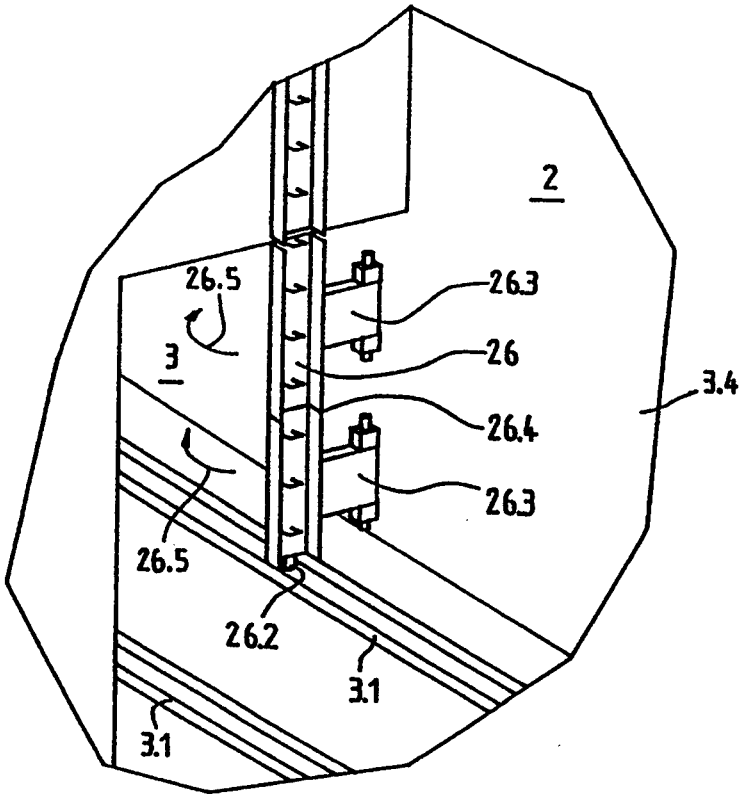
FIG. 11 is a fragmentary perspective view, similar to the FIG. 6, showing an alternate embodiment pivoting mechanism for the lower vertical guide rails.

There is shown in the FIG. 11 an alternate embodiment of the guide rail portion 6. A lower vertical movable guide rail portion 26 is attached to a back or rear wall 3.4 of the shaft 3 by a pair of pivoting mechanisms 26.3. Thus, the rail portion 26 can be pivoted as shown by arrows 26.5 through an approximate 90° angle about a vertical axis against the rear wall 3.4 of the horizontal shaft 3 for freeing the elevator car for horizontal travel on the guide rails 3.1. one or both of the pivoting mechanisms 26.3 actuate a latching pin 26.2 to free the lower end of the guide rail 26 from the guide rail 3.1. The guide rail portion 26 can be separated, for example in a center 26.4, into two sections which abut one another. The lower one of the pivoting mechanisms 26.3 can include an internal mechanism (not shown) which permits the lower section of the guide rail portion 26, when loaded by the elevator car, to be lowered by one or two centimeters in order to preliminarily fold back as preparation for an horizontal travel at an intermediate floor as discussed below.

Figure 12:
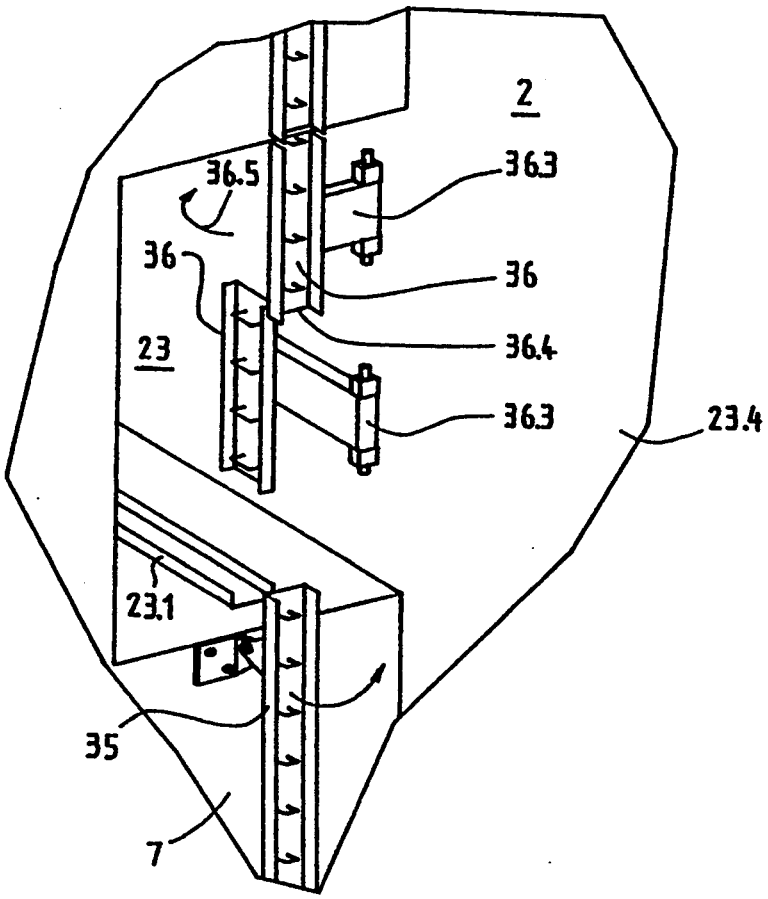
FIG. 12 is a fragmentary perspective view of an intersection of an horizontal elevator shaft with a vertical elevator shaft at an intermediate floor according to the present invention.

A construction used for horizontal travel at an intermediate floor is shown in the FIG. 12. An horizontally extending elevator shaft 23 intersects the vertical elevator shaft 2 above the bottom thereof. An upwardly pivotable movable guide rail portion 35 is attached to the shaft wall 7 and can be pivoted upwardly about an horizontal axis into an horizontal position by means of a not illustrated mechanism. In the horizontal position, the guide rail portion 35 forms a continuation of a horizontal guide rail 23.1 in the shaft 23. A vertically extending movable guide rail portion 36 is attached to a rear wall 23.4 of the shaft 23 by a pair of pivoting mechanisms 36.3. Thus, the guide rail portion 36 can be pivoted as shown by an arrow 36.5 through an approximate 90° angle about a vertical axis against the rear wall 23.4 of the horizontal shaft 23 for freeing the elevator car for horizontal travel on the guide rail 23.1. The guide rail portion 36 can be separated, for example in a center 36.4, into two sections which abut one another.

The apparatus described above operates as follows:

The functional principle is initially described by reference to the FIGS. 1 through 6. The drive motor 10 drives the conveying chains 4 in the desired direction by way of the reduction gears 9.1 and the chain wheels 9. Let it be assumed initially that a vertical travel direction is desired. When the left-hand chain wheel 9, shown in the FIG. 2, rotates in a clockwise direction, the conveying chain 4 moves in a downward direction after leaving the upper deflecting roller 13 and raises the car 1 in an upward direction. The lifting effect for the car 1 is generated by each second (or nth) roller 4.1 of the conveying chain 4 running off of the upper deflecting roller 13 and onto an adjacent one of the steps 5.1 of the guide rail 5. Due to the slight inclination of the step 5.1, as shown in the FIGS. 3*a* and 3*b*, the car 1 is urged by the small, but steady force Pq against the facing surface of the base 5.4 of the guide rail 5. Due to this urging of the conveying chain 4 into the guide rail 5, the contact pressure generating equipment, usual in such drives, is not required. The spacing of the steps 5.1 in the guide rail 5 is chosen in dependence on the criteria of lifting load, speed, number of conveying chains 4, dimensions of the co-operating components, safety and reserve. As an example, it can be recommended that at least four steps 5.1 be provided for each engagement region of a conveying chain 4. The car can be moved upwardly and downwardly in this manner. The conveying chains 4, be it two, three or four on the car 1, run at synchronous speed one with the other. The guide rails 5 and 6, while guiding the car 1 in the vertical direction, also have transverse legs which prevent movement of the car in the horizontal plane.

For travel in the horizontal direction, let it be assumed that such travel is to take place at the lowermost floor. Such horizontal travels serve to permit the car 1 to change vertical shafts or travel into a lateral buffer space. The car 1 travels down the vertical shaft 2 to this lowermost stop. Then, for the purpose of relieving the load on the steps 5.1 in the pivotable guide rail portion 6, the lateral support plungers 14 are extended until the rollers 4.1 are raised off of the steps 5.1 by a few millimeters. Then, the guide rail portion 6 is pivoted upwardly to the ceiling 8 on the side of the car 1 corresponding to the desired direction of travel and the support plungers 14 are retracted. Now, the car 1 rests on the projecting flanges 12.1 of the lower deflecting rollers 12 and similar flanges on the deflecting and tensioning rollers 11 which engage the vertically extending legs 3.3 of the horizontal guide rails 3.1. The car 1 can now move horizontally driven by the conveying chains 4 which rotate the rollers 11 and 12.

For a subsequent vertical travel in a neighboring shaft, the described cycle takes place in the appropriate sense in a reverse sequence. The process of the change between vertical and horizontal travel in the lowermost stop is in principle always the same independent of variations of embodiment of the drives and rails. For reasons of saving of space, one will always give preference to the embodiment of the guide rail portion 26 shown in the FIG. 11 for a change between neighboring vertical shafts. In place of the upwardly pivoting rail portions 6, the space-saving folding-back of the guide rail portion 26 to the side wall 3.4 of the horizontal shaft 3 then takes place.

The change from vertical to horizontal travel at an intermediate floor is, in principle, the same. However, a few additional functions are required in the absence of a bottom wall of the elevator shaft. Such a change in the direction of travel, with reference to the FIG. 12, consists of the following operations:

- Stopping of the car 1 at the intermediate floor horizontal shaft 23;
- Relief of the chain 4 in the lower section of the guide rail portion 36 by a slight lowering by the lower pivoting mechanism 36.3;
- Folding-back of the lower section of the guide rail portion 36;
- Folding-up of the vertical guide rail portion 35 into a horizontal position;
- Supporting the car 1 on the folded-up guide rail portion 35 by extending the support plungers 14;
- Folding-back of the upper section of the guide rail portion 36;
- Retraction of the support plungers 14;
- Analogous preparation for horizontal entry into the shaft 23;
- Horizontal travel to another and appropriately prepared vertical shaft;
- Setting up for vertical travel in the vertical shaft 2 departed from; and
- After arrival in the neighboring shaft, reverse sequence of the initially described operations as preparation for vertical travel.

The principle of the conveying chains 4 bearing on the steps 5.1 in guide rails 5 and rail portions 6 makes possible different embodiments. The conveying chains 4 can be arranged one diagonally opposite the other as shown in the FIGS. 2, 4 and 5. The advantage of this arrangement is that the drive on the one hand and the chain tension and safety device on the other hand can be arranged one functionally separate from the other. The drive means embodiment shown in the FIGS. 8, 9*a* and 10 has the advantage of smaller space requirements in the elevator car.

When drivable, retractable and extendable support rollers 16, which are rotatable about the lifting axis as shown in the FIG. 8, are used, the possibility exists of moving the car 21 on a guideless plane in any desired horizontal direction like a land vehicle. In the case of the embodiment shown in the FIG. 9*b*, the lower deflecting rollers 12 take over the transport function on the guide rails 3.1 in the horizontal direction.

The extendible and retractable support plungers represented by the plungers 20 in the FIG. 9*a*, and the plungers 14 shown in the FIG. 4, can be installed in the base of the lower horizontal shaft 3 instead of underneath each car 1 as shown by the plungers 17 in the FIG. 6. In this variation, the cars 1 do not have to be provided with support plungers, but only require the conveying chains 4 with the appropriate drives.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A vertical-horizontal passenger conveying system including cars having individual drives for travel in intersecting vertical and horizontal shafts and fixed and movable guide rails mounted in the shafts which are engaged by the drives wherein more than one of the cars can travel in the same shaft at the same time, comprising:

an elevator car having at least one endless conveying roller chain a portion of which extends outside a side wall of said car in a generally vertical direction;

drive means mounted on said car and connected to said chain for moving said chain;

at least one vertical guide rail for attachment to a side wall of a vertical elevator shaft, said vertical guide rail having a plurality of steps formed thereon for engaging said chain;

at least one horizontal guide rail for attachment to a bottom wall of an horizontal elevator shaft intersecting the vertical elevator shaft, said vertical guide rail having a movable rail portion for pivotally mounting at the intersection of the vertical and horizontal shafts in alignment with said horizontal guide rail;

a deflecting roller rotatably mounted on said car, said chain extending partially around said deflecting roller, said deflecting roller being driven by said chain and engaging said horizontal guide rail when said car travels in the horizontal shaft; and retractable and extendable support means mounted on one of said car and a bottom wall of the intersection of the vertical and horizontal shafts for supporting said car to relieve said chain from engagement with said steps whereby said movable rail portion can be pivoted away from said car.

2. The system according to claim 1 wherein said drive means includes a motor mounted in said car, a chain wheel rotatably mounted in said car and engaging said chain and a reduction gear connected between said motor and said chain wheel whereby said motor moves said chain by driving said chain wheel through said reduction gear.

3. The system according to claim 2 including a chain tensioning and safety means mounted in said car and having a motor sliding guide mounted in said car for slidably retaining said motor, a push-rod being attached to a point of rotation of said chain wheel, a spring having one end attached to said car and an opposite end attached to said motor for tensioning said chain, an opposite end of said push-rod extending outside said car, said opposite end of said push-rod being attached to a brake shoe whereby when tension is lost on said chain, said spring urges said brake shoe into engagement with an adjacent wall of an elevator shaft to stop travel of said car.

4. The system according to claim 3 including a switch cam attached to said spring, a switch contact mounted on said car and an electrical line connected to said switch contact whereby when tension is lost on said chain, said spring moves said switch cam into engagement with said switch contact for generating a signal on said electrical line.

5. The system according to claim 1 including a chain tensioning and safety means mounted in said car and engaging said chain for tensioning said chain and, when tension is lost on said chain, urging a brake shoe into engagement with an adjacent wall of an elevator shaft to stop travel of said car.

6. The system according to claim 5 wherein said chain tensioning and safety means includes a rotatably mounted tensioning and deflecting roller engaging said chain, a push-rod being attached to a point of rotation of said tensioning roller, a spring having one end attached to said car and an opposite end attached to one end of said push-rod for tensioning said chain, an opposite end of said push-rod extending through a guide and outside said car, said opposite end of said push-rod being attached to said brake shoe whereby when tension is lost on said chain, said spring urges said brake shoe into engagement with an adjacent wall of an elevator shaft to stop travel of said car.

7. The system according to claim 6 including a switch cam attached to said spring, a switch contact mounted on said car and an electrical line connected to said switch contact whereby when tension is lost on said chain, said spring moves said switch cam into engagement with said switch contact for generating a signal on said electrical line.

8. The system according to claim 1 wherein said chain is formed of a plurality of evenly spaced interconnected rollers and said steps formed on said vertical guide rail extend from said vertical guide rail at a positive angle to a generally horizontal plane and are spaced apart by an integer multiple of a spacing between adjacent ones of said rollers in said chain.

9. The system according to claim 1 wherein said support means includes at least one support plunger for mounting in a bottom wall of the horizontal shaft at the intersection with the vertical shaft, said support plunger being selectively retractable and extendable for engaging an underside of said car.

10. The system according to claim 1 wherein said support means includes at least one support plunger mounted in an underside of said car, said support plunger being selectively retractable and extendable for engaging said horizontal guide rail.

11. The system according to claim 1 wherein said support means includes a plurality of drivable, retractable and extendable support rollers each mounted on a lifting axis on an underside of said car, said support rollers being rotatable about said lifting axes.

12. The system according to claim 1 including a pivoting mechanism attached to said movable rail portion for mounting said movable rail portion on a side wall of the horizontal shaft and a latching mechanism attached to said movable rail portion and actuated by said pivoting mechanism for releasably engaging said horizontal guide rail to maintain said movable rail portion in a generally vertical position.

13. The system according to claim 1 wherein said movable rail portion includes upper and lower sections and including a pair of pivoting mechanisms attached to respective ones of said sections for mounting said sections to a side wall of the horizontal shaft and a latching mechanism attached to said movable rail portion and actuated by said pivoting mechanism attached to said lower section for releasably engaging said horizontal guide rail to maintain said movable rail portion in a generally vertical position.

14. The system according to claim 1 including a pivoting mechanism attached to said movable rail portion for mounting said movable rail portion for upward pivotal movement to an horizontal position.

15. The system according to claim 1 wherein said deflecting roller has radially extending flanges formed thereon for engaging said horizontal guide rail when said car travels in the horizontal shaft.

16. The system according to claim 15 wherein said horizontal guide rail has transversely extending legs formed thereon for engaging said flanges.

17. The system according to claim 1 including a tensioning roller rotatably mounted in said car and engaging said chain, said tensioning roller having radially extending flanges formed thereon for engaging said horizontal guide rail when said car travels in the horizontal shaft.

18. A vertical-horizontal passenger conveying system including cars having individual drives for travel in vertical and horizontal shafts and fixed and movable guide rails mounted in the shafts which are engaged by the drives wherein more than one of the cars can travel in the same shaft at the same time, comprising:

an elevator car having at least two endless conveying roller chains a portion of each extending outside opposite side walls of said car in a generally vertical direction;

drive means mounted on said car and connected to said chains for moving said chains;

at least two vertical guide rails for attachment to opposite side walls of a vertical elevator shaft, each of said vertical guide rails having a plurality of steps formed thereon for engaging an associated one of said chains;

at least two horizontal guide rails for attachment to a bottom wall of an horizontal elevator shaft intersecting the vertical elevator shaft, said vertical guide rails each having a movable rail portion for pivotally mounting at the intersection of the vertical and horizontal shafts in alignment with an associated one of said horizontal guide rails;

at least one deflecting roller rotatably mounted on said car for each of said chains, each said chain extending partially around an associated one of said deflecting rollers, each said deflecting roller being driven by said associated chain and engaging an associated one of said horizontal guide rails when said car travels in the horizontal shaft; and at least one chain tensioning and safety means mounted in said cars for each of said chains for tensioning said chains, for actuating a brake shoe against a wall of the vertical shaft when tension is lost on an associated one of said chains and for generating a signal when tension is lost on an associated one of said chains.

19. The system according to claim 18 including retractable and extendable support means mounted on an underside of said car for engaging said horizontal guide rails and supporting said car to relieve said chains from engagement with said steps whereby said movable rail portions can be pivoted away from said car.

20. A vertical-horizontal passenger conveying system including cars having individual drives for travel in vertical and horizontal shafts and fixed and movable guide rails mounted in the shafts which are engaged by the drives wherein more than one of the cars can travel in the same shaft at the same time, comprising:

a plurality of elevator cars, each said car having at least two endless conveying roller chains with a portion of each said chain extending outside an associated side wall of said car in a generally vertical direction;

drive means mounted on each of said cars and connected to said chains for moving said chains;

at least two vertical guide rails for attachment to opposite side walls of a vertical elevator shaft, said vertical guide rails having a plurality of steps formed thereon for engaging said chains;

at least two horizontal guide rails for attachment to a bottom wall of an horizontal elevator shaft intersecting the vertical elevator shaft, said vertical guide rails each having a movable rail portion for pivotally mounting at the intersection of the vertical and horizontal shafts in alignment with an associated one of said horizontal guide rails;

at least one deflecting roller rotatably mounted on each of said cars for each of said chains, each of said chains extending partially around an associated one of said deflecting rollers, each of said deflecting rollers being driven by an associated one of said chains and engaging an associated one of said horizontal guide rails when said cars travel in the horizontal shaft;

at least one chain tensioning and safety means mounted in said cars for each of said chains for tensioning said chains, for actuating a brake shoe against a wall of the vertical shaft when tension is lost on an associated one of said chains and for generating a signal when tension is lost on an associated one of said chains; and retractable and extendable support means mounted on one of said cars and a bottom wall at the intersection of the vertical and horizontal shafts for supporting said cars to relieve said chains from engagement with said steps whereby said movable rail portions can be pivoted away from said cars.

* * * * *